United States Patent [19]

Lee et al.

[11] 4,170,668

[45] Oct. 9, 1979

[54] METHOD FOR WOOD PRECHARRING

[75] Inventors: Calvin K. Lee; Robert F. Chaiken, both of Pittsburgh, Pa.

[73] Assignee: The United States of America as represented by the Secretary of the Interior, Washington, D.C.

[21] Appl. No.: 942,851

[22] Filed: Sep. 15, 1978

[51] Int. Cl.[2] ..... B05D 3/08; B05D 3/02

[52] U.S. Cl. ..... 427/223; 34/13.8; 427/55; 427/317; 428/907; 428/921

[58] Field of Search ..... 427/317, 55, 223, 393, 427/397; 34/13.8; 428/907, 921

[56] References Cited

U.S. PATENT DOCUMENTS

| | | | |
|---|---|---|---|
| 18,828 | 12/1857 | Tenney et al. | 52/560 |
| 35,811 | 7/1862 | Lapparent | 427/227 X |
| 3,369,919 | 2/1968 | Inglis | 427/223 |
| 3,671,299 | 2/1970 | Barnett | 428/907 X |
| 4,064,386 | 12/1977 | Numrich | 219/68 |
| 4,071,637 | 1/1978 | Dittrich | 427/317 X |

FOREIGN PATENT DOCUMENTS

| | | | |
|---|---|---|---|
| 328 | 7/1862 | United Kingdom | 427/223 |

*Primary Examiner*—Michael R. Lusignan
*Attorney, Agent, or Firm*—Thomas Zack; Donald A. Gardiner

[57] ABSTRACT

A method of forming a prechar-layer on wood to cause it to become fire and rot retardant. In an air or a low oxygen concentration atmosphere the wood is uniformly charred at a depth of at least 3 millimeters by a high-intensity radiant heat panel. Normally the heat panel is spaced from and moved with respect to the wood. The relative velocity of the wood past the radiant panel and the panel's emitted heat flux are used to control the depth of charring. Preferably fire and/or rot retard chemicals and/or treatments are added to the formed charred layer to further increase the wood's fire and rot retardancy.

6 Claims, 1 Drawing Figure

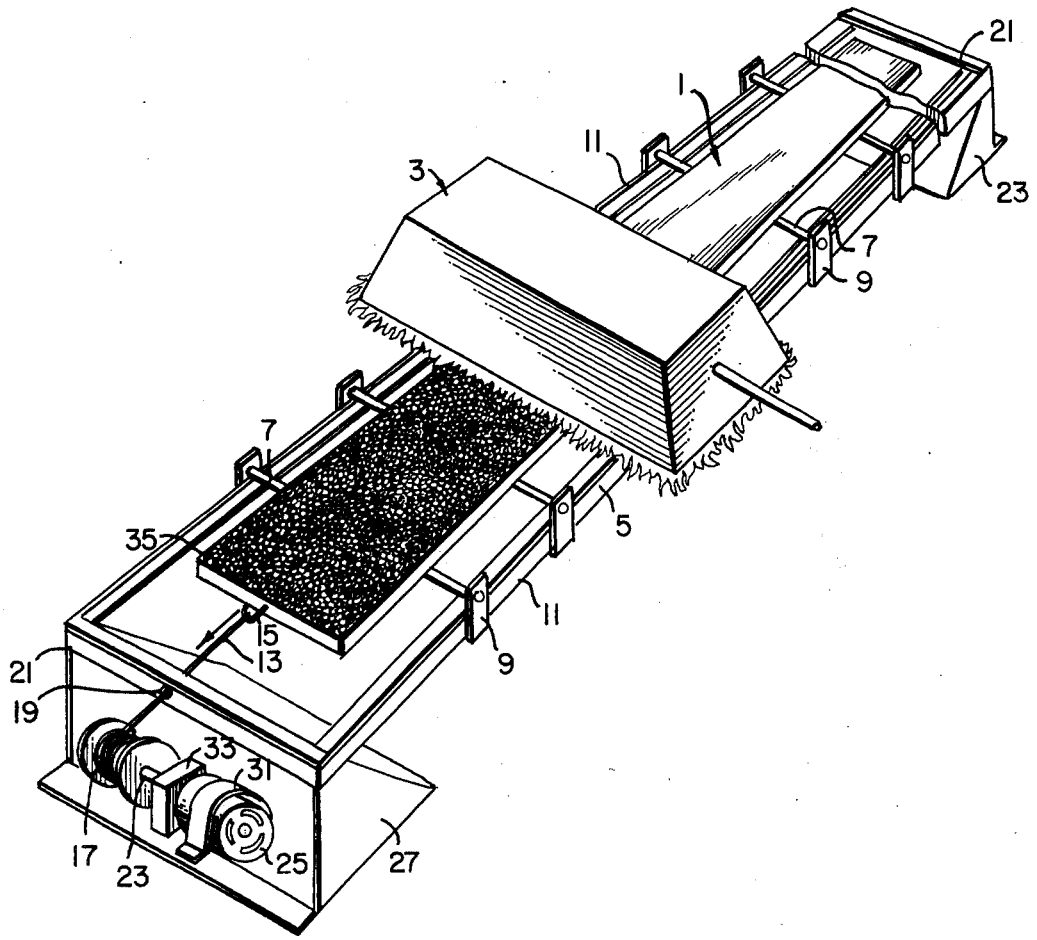
21
1
11
3
23
7
9
7
35
5
11
15
13
9
21
19
33
31
17
23
25
27

METHOD FOR WOOD PRECHARRING

BACKGROUND OF THE INVENTION

1. Field of the Invention

This invention relates to a method of treating wood to increase its fire and rot retardancy characteristics.

2. Description of the Prior Art

In many environments it is very desireable to minimize the susceptibility of wood to fire and/or rot. Both of these potentially damaging characteristics of wood are particularly prevalent in the mining field where wooden supports and framing members are continuously exposed to the dangers of fire and rot. The early U.S. Pat. No. 35,811 (Lapparent) recognizes that virgin wood may be surface charred to reduce its normal tendency to decay and rot. To achieve its charred layer Lapparent has its wood exposed to jet burners and thus in contact with opened flames. In the U.S. Pat. No. 1,009,436 (Partridge et al) a board is placed inside a chamber which is heated by a series of burners outside of the chamber. Heating of the chamber takes place until . . . "the surface of the board takes fire and burns evenly throughout its entire surface while passing through the chamber." (page 2, lines 39–41). The Schmid U.S. Pat. No. (1,758,336) discloses a board being passed between two oscillating torches to char its surface with brushes afterwards being used to remove the charred surface. With these three methods, flaming combustion of the wood occurs which means the charring process is governed by the heat flux from the flame on the wood surface as well as from the external heat sources of burners and torches. This form of heat flux is difficult to control—as would be the directly apply heat from any external torches or burners—; more likely to burn away the char-layer to produce ash; has little likelihood of producing a uniform char-layer; and may partially decompose the wood below the char-layer to detract from the wood's strength without adding any corresponding fire retardancy benefit.

The prior art also discloses—U.S. Pat. No. 18,828 to Tenney et al.—the use of a heated roller to char wood to increase the wood's fire and rot retardancy. With this method flaming combustion, with all of its mentioned drawbacks could occur; if the temperature of the hot roller was sufficiently high. If the temperature of the wood roller contact surface were kept sufficiently low to avoid flaming combustion, the time required to form the minimum depth char-layer (3 mm) found acceptable by us would according to our calculations be about three times greater. Further, since the roller's contact surface is flat—as contrasted against the high surface radiant heat flux we employ—it is limited mainly to flat wood surfaces whereas we can accommodate various contours and shapes. One additional advantage in using radiant energy over a contact heat source is the lack of pressure on the char-layer surface, such pressure being capable of damaging the structural integrity of the wood.

SUMMARY OF THE INVENTION

Our invention is a method of precharring wood to a surface depth of at least three millimeters. Initially the wood to be charred is positioned near, but not in physical contact with, a source of radiant heat which emitts to the wood's surface at least 0.5 calories per square centimeter per second. The source of radiant heat is caused to radiate upon the wood to be charred for a sufficient time to prechar its surface layer to a substantially uniform depth of at least three millimeters but not sufficient to start gaseous flaming combustion on the wood to produce ash. Preferably this should be done in an atmosphere with no oxygen or a very low concentration of oxygen. After the desired char-layer is made, chemical fire retardants may be applied to the charred surface to further enhance the wood's fire resistance.

The primary object of this invention is an improved method of treating wood to make it fire and rot retardant.

BRIEF DESCRIPTION OF THE DRAWING

The FIGURE illustrates the preferred embodiment of the apparatus set up for precharring wood according to this invention.

The drawing depicts how the preferred embodiment can be practiced. The wood board 1, whose upper surface is to be preheated to form a very discrete layer of in-situ char, is separated from and moved under a fixed radiant panel 3, whose radiation is directed downwardly. A steel channel support assembly 5 supports the board. This assembly has several members including two separated parallel identical elongated size frame members 11 that extend in the same direction as the wood board having a series (eight shown) of vertical supports 9 fixed to the side members. Extending from the upper portion of each aligned vertical support on one side member to a identical vertical support on the other side member is a roller rod numbered 7. These roller members are freely journalled for rotational movement at their ends into their two respective vertical supports. Attached to the front of the board by a hook 15 or similar fastening device is the wire 13. A spool 17 contains the wound wire which extends through a small guide hole 19 in the end channel member 21. A centrally located shaft 23 supports the spool above the base of the channel frame and transmits rotational movement thereto from the electric drive motor 25. Also shown are the two end base members 27 and 29 of the channel assembly which are connected to their respective rigidly jointed end members 21 near where they join the side members 11. Each base member has a flat base joined to two vertical support sides. The channel support assembly can be seen to consist of the two side members 11, the vertical supports 9, the two end members 21, the rollers 7, and the two base members 27 and 29. It is in this flat base member that a band clamp 31 and block clamp 33 are fixed to provide supports for the electric motor and shaft 23.

The darkened area 35 represents the uniform precharred layer of the wooden board 1 after it has passed under the radiant panel on the horizontal support rollers. This treatment involves preheating of the wood surface with a high surface heat flux (ranging from 0.5 cal./cm$^2$ sec to 2.0 cal./cm$^2$sec.) to form an in situ surface char-layer (~3 mm thick) on the wood. Although not absolutely necessary, to prevent the possibility of flaming combustion of the wood, the preheating should preferably be done in an atmosphere that has no or a very small concentration of oxygen. The char-layer is a discrete layer which imparts a resistance to ignition and burning of the precharred wood in a fire environment. These fire retardant effects of the precharring technique have been confirmed by standard American Society of Testing and Materials (ASTM) flammability tests and laboratory scale fire tests as set forth hereinafter.

The wood pyrolysis rate in $m_p''$ decreases with time as a surface char-layer builds up. For flaming combustion to occur at the wood's surface of virgin wood the value of $m_p''$ would typically have to be maintained at a threshold value somewhere between $0.1\times10^{-3}$ to $2.2\times10^{-3}$ grams per centimeter squared per second. With the prechar-layer, we propose creating on the wood, the initial high peak value of $m_p''$ is eliminated resulting in less opportunity for flaming ignition to occur as compared to virgin wood. This decrease in $m_p$ by the prechar-layer is due to the following: (1) Thermal insulation effect—The prechar-layer is a poor thermal conductor, and hence good thermal insulator, (its thermal conductivity is about two to three times less than virgin wood) and an excellent black body radiant heat emitter (reradiation as high as 80% of the incident heat flux of 2 cal/cm2 sec by the char surface was measured). Thus, heat transfer from an external source to the underlying virgin wood is partially blocked by the prechar-layer. (2) Pre-gasification effect—the formed prechar-layer consists mainly of carbon with relatively little volatile matter content. This allows it to sustain relatively high temperatures without giving off flammable gases. Flaming combustion would only occur when the pyrolysis gases are generated from heating the virgin wood beneath the prechar-layer.

Theoretical and experimental studies have been made to investigate the effectiveness of the thickness of the prechar-layer ($d_c$) with respect to its fire-retardant mechanism. The United States Bureau of Mines Report of Investigations (hereinafter referred to as the RI) No. 8299, incorporated by reference herein, co-authored by us and Joseph M. Singer and first published in August, 1978, entitled "Wood Precharring: A Novel Fire-Retardancy Technique" details the results of tests and analysis with respect to this point. The conclusions to be drawn are that: the theoretical results are in good qualitative agreement with experiments; and at $^{d}c=5$ mm the lower limit for the threshold pyrolysis rate for flaming combustion is theoretically reached and experimentally at a char depth 2 or 3 times higher. At the lower limit of the threshold pyrolysis rate, flaming ignition is delayed by the char layer. This is comfirmed by the fire tests of precharred wood as shown below.

Tests were made to ascertain the flame spread characteristics of the precharred wood against (1) virgin wood and (2) virgin wood coated with fire-retardant chemicals of intumescent paint, sodium silicate, and zinc chloride. The woods selected were spruce, beech, and oak. When precharred, each type was precharred to a depth of 3 mm. It was noted that during tests all virgin woods showed rapid downward surface flame spread rates, the sodium silicate and zinc chloride coating decreased the flame spread rate somewhat, and the flame did not spread on the precharred and intumescent paint coated woods. These tests conducted were the ASTM E-162 Radiant Panel Test which tests the surface flammability of materials in terms of a flame spread index $I_s$ where the $I_s$ for red oak is 100 and for asbestos 0. Pages 8–10 of the referenced RI give additional details of the tests plus the tabulated results of Table 1. When a prechar-layer is formed on wood and that layer is chemically treated with a fire-retardant chemical, like zinc chloride, the flame spread index for this double fire-retardant treatment is lower than those of each individual treatment. Thus, the effectiveness of the precharring technique can be further improved by the prechar-layer being coated with chemical, viz. the ASTM E-162 Radiant Panel Test with spruce wood, a prechar-layer (3 mm) and zinc chloride had a $I_s=5$ versus $I_s=11$ with precharring alone and $I_s=30$ with a zinc chloride coating alone.

In addition to the ASTM E-162 test, flammability and related characteristics of the precharred wood samples were also tested against virgin wood according to the ASTM E84 Tunnel Test. Virgin white pine was tested against precharred white pine ($d_c$ or char depth=2–3 mm). Flaming ignition was twice as long (30 sec. vs. 1 minute) for the precharred sample compared to the virgin sample after exposure to the gas burners. Flames actually covered 5 meters versus 2.7 meters for the virgin and precharred pine, respectively, during the same test at the end of 10 minutes. As indicated on pages 10–11 of the referenced RI the initial flame spread rate of the virgin wood is about seven times higher than precharred wood and an overall higher flame resistance for the precharred wood than virgin wood is evident.

Two additional tests—laser irradiation test and a model tunnel fire test—were also conducted on the precharred sample for comparative purpose. Details of these test are set forth on pages 7–8 and 11–18, respectively, of the referenced RI. The model tunnel fire test was probably the most important test conducted. It was the most severe flame spread rate test employed. The test results support the general finding that fire retardant treatments become less effective as the fire environment becomes more severe.

The laser irradiation technique is an experimental setup which uses a 250 watt continuous $CO_2$ laser as an ignition source. Details on the technique are described on page 1459 of the paper entitled "Charring Pyrolysis of Wood in Fires by Laser Simulation" by the inventors and J. M. Singer and released at the Sixteenth International Symposium on Combustion in 1977 at Pittsburgh, Pennsylvania. The $CO_2$ laser supplies a radiation beam (2 cm in diameter) of fire-level surface heat—up to 4 cal/cm$^2$ sec.—directed onto the top surface of an insulated wood cylinder which stands upright on a weighing cell. Numerous measurement devices are employed to follow the pyrolysis process which includes total mass loss, temperature, internal gas pressure, gas analysis, and local wood density. FIG. 6 of the referenced RI schematically illustrates the set up for the laser irradiation experiment.

The very important Bureau of Mines' model tunnel fire test was constructed to study small-scale tunnel wood fires and to model large-scale mine timber fires. The tunnel in which the tests were conducted consisted of separate flow control, ignition, test, and cooling sections. In the test section two fire tests were performed, one with virgin oak lining and one with precharred oak lining ($d_c$=2–2 mm). For the precharred oak test, virgin oak was used in the last 1.2 mm of the lining to examine the fire-break effect of precharred wood. For both tests, the exhaust fan was set at a constant speed which ventilated the room air in the tunnel at a velocity of 1.5 m/sec; and virgin oak was used as the ignition source in the ignition section. During the tests, the entrance gate between the ignition and test sections were first closed and the exhaust gate in the stack of the ignition section was opened. As explained in the RI, the virgin wood is then ignited in the ignition section by a multi-port gas fired lance. The goal of the tunnel fire test was to compare the ignition delay, flame spread, and subsequent fire build-up of the virgin and precharred oak. The results of the Bureau of Mine's tunnel test when compared against the ASTM-84 Tunnel Test and the ASTM E-162 Radiant Panel Test were as follows:

| Test | Flame Spread Ratio | |
|---|---|---|
| | $I_{s,p}/I_{s,v}$ | $U_p/U_v$ |
| E - 162 | 0.1 | 0 |
| E - 84 | 0.63 | 0.575 |
| Bureau of Mines Tunnel | — | 0.659 |

All tests were on precharred and virgin wood. $U_p$ and $U_v$ are the flame spread rates of precharred and virgin oak, respectively. And $I_s$ the flame spread index as compared to the standards of red oak ($I_s=100$) and asbestos ($I_s=0$) for precharred oak ($I_s$, p) and virgin oak ($I_s$, v). In conformity with the earlier stated findings for the E-162 and E-84 tests, these test results support the general finding that fire retardant treatments become less effective as the fire environment—as in the Bureau of Mine's tunnel test—becomes more severe. Two additional fire tests on virgin and precharred oak where also performed in the U.S. Bureau of Mine's fire tunnel. The results of these tests shown that all fire processers of ignition delay, flame spread, generation of toxic gases and smoke, and air throttling were delayed due to the precharring by at least three minutes. A research paper published in—entitled "Relative Hazard of Treated and Untreated Timber in Model Dust Fires" by ourselves and J. M. Singer details the results of these two additional tests.

Certain conclusions can be drawn from the four fire tests conducted on wood precharred according to the preferred embodiment of the invention. Our precharring method decreases the flammability of wood by delaying its ignition, decreasing the surface flame spread rate, decreasing the heat release rate, and lowering the generation rate of smoke particulates and toxic gases. Comparing our precharring method by itself against the other fire retardant treatments we used it may be concluded that: (1) our method is more simple and probably less expensive than to utilize most high pressure chemical impregnation processes; (2) it eliminates possible biological effects on human beings, such as skin allergy and the evolution of toxic gases; (3) our method preserves the natural structure and integrity of the virgin wood beneath the prechar layer; and (4) the prechar-layer should be relatively stable and in- sensitive to environmental changes, such as humidity and water leaching.

Other potential uses and modifications to our disclosed precharring method are possible. As indicated heretofore, it may be used with chemical agents to further increase its fire retarding characteristics. The cracks and highly porous nature of the formed char-layer would make it ideally suited for absorption and retention of additional rot resistant agents, like zinc chloride ($Zn\ Cl_2$) or zinc chloride, chromated. Preferably our process should be performed in an ambient atmosphere that is inert relative to oxygen such that the possibility of flaming combustion of the wood is eliminated. This would allow the formed precharred layer to be relatively thick. However, for practical purposes, a maximum char-layer thickness of 5 mm seems to be appropriate. None of these proposed changes or modifications should be used to alter the scope and extent of our invention which is to be measured only by the claims which follow.

We claim:

1. A method of treating the surface of wood to increase its resistance to fire and rot comprising the steps of:

(1) positioning the wood whose surface is to be treated so that it is spaced a given distance from a source of radiant heat energy which source is capable of emitting at least 0.5 calories per centimeter per second of energy as measured at the to be treated wood's surface;

(2) using the radiant heat energy source to char the wood's surface to be treated to a non-flaming uniform depth layer throughout the surface facing the source to at least 3 millimeters; and (3) moving the wood relative to the source of radiant heat so as to allow charring of the wood's surface to a discrete depth of at least 3 millimeters but prevent gaseous flaming combustion thereof.

2. The method of claim 1 wherein step (1) is performed by placing the wood in a generally horizontal inclination under the source of radiant energy.

3. The method of claim 2 wherein step (3) is accomplished by using a power source for moving the wood to be treated with respect to the stationary radiant heat energy source.

4. The method of claim 1 including the additional step (4) of treating the wood's charred surface with a chemical fire retardant to further increase its fire resistance.

5. The method of claim 4 including the additional step (5) of also treating the charred wood surface with a rot resistant agent to increase its rot resistance.

6. The method of claim 1 including the additional step (4) of performing step (2) in an atmosphere in which the concentration of oxygen is insufficient to support flaming combustion of the wood.

* * * * *